US007637448B2

(12) United States Patent
Hartnett et al.

(10) Patent No.: US 7,637,448 B2
(45) Date of Patent: Dec. 29, 2009

(54) PLASTIC CENTER SHREDDER DISC

(75) Inventors: David Hartnett, Carol Stream, IL (US); Alex Chen, SuZhou (CN); Dmitry N. Romanovich, Glen Ellyn, IL (US)

(73) Assignee: Fellowes, Inc., Itasca, IL (US)

( * ) Notice: Subject to any disclaimer, the term of this patent is extended or adjusted under 35 U.S.C. 154(b) by 152 days.

(21) Appl. No.: 11/677,359

(22) Filed: Feb. 21, 2007

(65) Prior Publication Data

US 2008/0197221 A1 Aug. 21, 2008

(51) Int. Cl.
*B02C 7/04* (2006.01)
*B02C 13/20* (2006.01)

(52) U.S. Cl. ..... 241/236; 241/295

(58) Field of Classification Search ..... 241/395, 241/236, 295

See application file for complete search history.

(56) References Cited

U.S. PATENT DOCUMENTS

| | | | | |
|---|---|---|---|---|
| 4,044,532 | A | 8/1977 | Lessig | |
| 4,068,805 | A | 1/1978 | Oswald | |
| 4,082,232 | A | 4/1978 | Brewer | |
| 4,125,228 | A | 11/1978 | Brewer | |
| 4,713,509 | A | 12/1987 | Chebowski | |
| 4,767,895 | A | 8/1988 | Parrish | |
| 4,821,967 | A | 4/1989 | Moriyama | |
| 4,839,533 | A | 6/1989 | Aga | |
| 4,910,365 | A | 3/1990 | Kuo | |
| 4,944,462 | A | 7/1990 | Raterman | |
| 5,045,648 | A | 9/1991 | Fogleman, Sr. | |
| 5,065,947 | A | 11/1991 | Farnsworth | |
| 5,100,067 | A | 3/1992 | Konig | |
| 5,135,178 | A | 8/1992 | Strohmeyer | |
| 5,207,392 | A | 5/1993 | Stangenberg | |
| 5,275,342 | A | 1/1994 | Galanty | |
| 5,295,633 | A | 3/1994 | Kimbro | |
| 5,568,895 | A | 10/1996 | Webb | |
| 5,655,725 | A | 8/1997 | Kroger | |
| 5,676,321 | A | 10/1997 | Kroger | |
| 5,829,697 | A | 11/1998 | Kroger | |
| 5,868,242 | A | 2/1999 | Hall | |
| 5,988,542 | A | 11/1999 | Henreckson | |
| 6,079,645 | A | 6/2000 | Henreckson | |
| 6,260,780 | B1 | 7/2001 | Kroger | |
| 6,513,741 | B2 * | 2/2003 | Hsu | 241/236 |

(Continued)

FOREIGN PATENT DOCUMENTS

| | | |
|---|---|---|
| CN | 84217868 | 12/1995 |

(Continued)

*Primary Examiner*—Bena Miller
(74) *Attorney, Agent, or Firm*—Pillsbury Winthrop Shaw Pittman LLP

(57) ABSTRACT

A shredder for shredding data bearing substrates has a housing and shredder mechanism with cutter elements for shredding paper. The cutter elements are positioned along two shafts and interleave with the other when rotated relative to each other. At least one of the cutter elements comprises a pair of outer blades, preferably made of metal, and an inner support, preferably made of a plastic. The outer blades and inner support are aligned circumferentially to form a cross-cut tooth. The outer blades and inner support may be designed such that they are snap-fit together. The outer blades may be formed from a stamping or punching process, and the inner support may be molded.

12 Claims, 11 Drawing Sheets

U.S. PATENT DOCUMENTS

| | | | | |
|---|---|---|---|---|
| 6,550,701 | B1 * | 4/2003 | Chang | 241/36 |
| D494,607 | S | 8/2004 | Hunag | |
| 6,779,747 | B2 | 8/2004 | McLean | |
| D502,713 | S | 3/2005 | Hunag | |
| D502,714 | S | 3/2005 | Hunag | |
| D502,715 | S | 3/2005 | Hunag | |
| 7,040,559 | B2 | 5/2006 | Matlin | |
| 7,044,410 | B2 | 5/2006 | Hunag | |
| 7,048,218 | B2 | 5/2006 | Hunag | |
| D536,717 | S | 2/2007 | Hunag | |
| D536,716 | S | 3/2007 | Smith | |
| 2005/0109866 | A1 | 5/2005 | Hunag | |
| 2005/0109867 | A1 | 5/2005 | Hunag | |
| 2006/0138266 | A1 | 6/2006 | Huang | |
| 2008/0265072 | A1 * | 10/2008 | Wang | 241/220 |

FOREIGN PATENT DOCUMENTS

| | | |
|---|---|---|
| CN | 306323 | 5/1997 |
| CN | 86215808 | 8/1998 |
| DE | 32 08 676 | 10/1982 |
| DE | 37 33 413 | 4/1987 |
| DE | 35 40 896 | 5/1987 |
| DE | 199 60 267 | 12/1999 |
| EP | 511 535 | 11/1992 |
| GB | 2 096 919 | 10/1982 |
| GB | 2 203 063 | 5/1988 |
| GB | 2 234 690 | 2/1991 |
| JP | 10-34003 | 2/1988 |
| JP | 4-11043 | 9/1992 |
| JP | 5-68906 | 3/1993 |
| JP | 5-123593 | 5/1993 |
| JP | 7-328469 | 12/1995 |
| WO | 98/48937 | 11/1998 |
| WO | 99/52638 | 10/1999 |
| WO | 02/060588 | 8/2002 |

* cited by examiner

PLASTIC CENTER SHREDDER DISC

BACKGROUND OF THE INVENTION

1. Field of Invention

The present invention is generally related to an apparatus having cutter elements for destroying data bearing substrates such as paper or discs. In particular, the cutter elements comprise a pair of outer blades and an inner support forming at least one cross-cut tooth.

2. Background

The use of shredders is well-known for shredding data bearing substrates such as documents and papers or discs such as CDs, DVDs, etc.

A common type of shredder has a shredder mechanism contained within a housing that is removably mounted atop a container. The shredder mechanism typically has a series of cutter elements that shred data bearing substrates such as paper and discs fed therein, and discharges the shredded articles downwardly into the container.

Prior shredders typically include a plurality of cutter elements arranged on a pair of shafts in an interleaved manner for shredding substrates. The cutter elements are typically made of a single piece of metal of a predetermined thickness, or from two halves joined or stacked together.

Another type of known cutting element is made by punching and bending. The cutter element is punched from a sheet metal to create the cutter element body. Then portions of the cutter element are bent to form cutting edges. An example of this type of cutting element is shown in U.S. Patent Application 2005/0109866 A1.

Also known in the art is the use of cutter elements formed by assembling two thin, stamped blades together. The two blades in each cutter element meet at relatively flat areas where cross-cutting teeth are formed, and are otherwise curved so that they are separated from one another. The central portions of each blade protrude as a spacer to keep the cutting parts of adjacent cutter elements spaced apart. This allows for interleaving of cutter elements on two parallel shafts. U.S. Pat. No. 7,044,410 provides an example of this type of cutter element. It is also known to add a piece of plastic between of the two blades of each cutter element for added support and stability.

SUMMARY OF THE INVENTION

One aspect of the invention provides a shredder for shredding data bearing substrates, the shredder having a housing and a shredder mechanism received in the housing including an electrically powered motor and a plurality of cutter elements. The shredder mechanism enables one or more data bearing substrates to be fed into the cutter elements, and the motor is operable to drive the cutter elements so that the cutter elements shred the one or more data bearing substrates. The housing has an opening enabling the one or more data bearing substrates to be fed therethrough into the cutter elements of the shredder mechanism. The shredder mechanism further comprises a first shaft and a second shaft that rotate relative to each other, and the first and second shafts are coupled to the motor to enable the motor to rotate the shafts. The cutter elements are positioned along the first and second shafts such that the cutter element on each shaft are received in an interleaving relationship with the cutter elements of the other shaft.

One or more of the cutter elements each include a pair of outer blades and a inner support positioned between the outer blades. In each of the cutting elements, the outer blades include at least a pair of integral cross-cut tooth portions aligned circumferentially with the one another, and the inner plastic support includes an integral tooth support portion aligned circumferentially with and positioned between each pair of cross-cut tooth portions and to support the cross-cut tooth portions.

The outer blades may be formed from steel and the inner support formed from molded plastic. The outer blades may be formed using a stamping or punching process. Preferably, but not necessarily, the outer blades and inner support are snap-fit together.

Another aspect of the invention provides a method of forming a cutter element for shredding data bearing substrates, in which a plurality of cutter elements are positioned along a rotatable shaft to shred substrates that are inserted in an opening in a housing of a shredder, wherein the cutter elements are a part of a shredder mechanism that is activated by a motor in the housing, and the motor rotates the shaft to rotate the plurality of cutter elements. The method comprises: forming a pair of outer blades including at least a pair of integral cross-cut tooth portions; forming an inner support including an integral tooth support portion; positioning the inner plastic support between the pair of outer blades; aligning circumferentially the cross-cut tooth portions of said outer blades with the cross-cut tooth portion of the inner plastic support; and connecting the pair of outer blades to the inner support to form and support a cross-cut tooth portion on the cutter element.

The forming of the pair of outer blades may comprise stamping. The forming of the inner support may comprise molding. Preferably, but not necessarily, the method of connecting the pair of outer blades and inner support is through a snap-fit connection.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
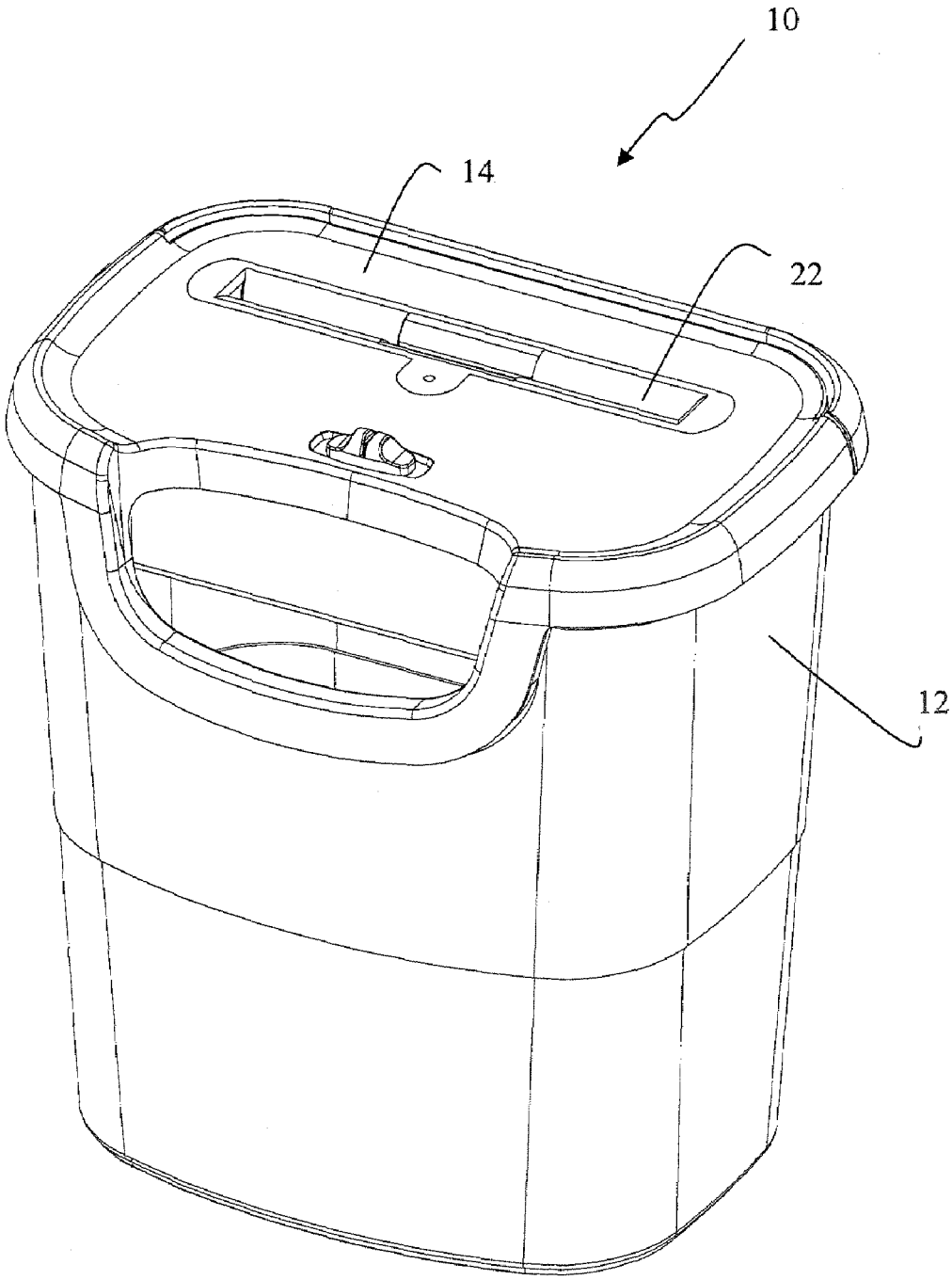
FIG. 1 is a perspective view of a shredder in accordance with present invention.
Figure 2:
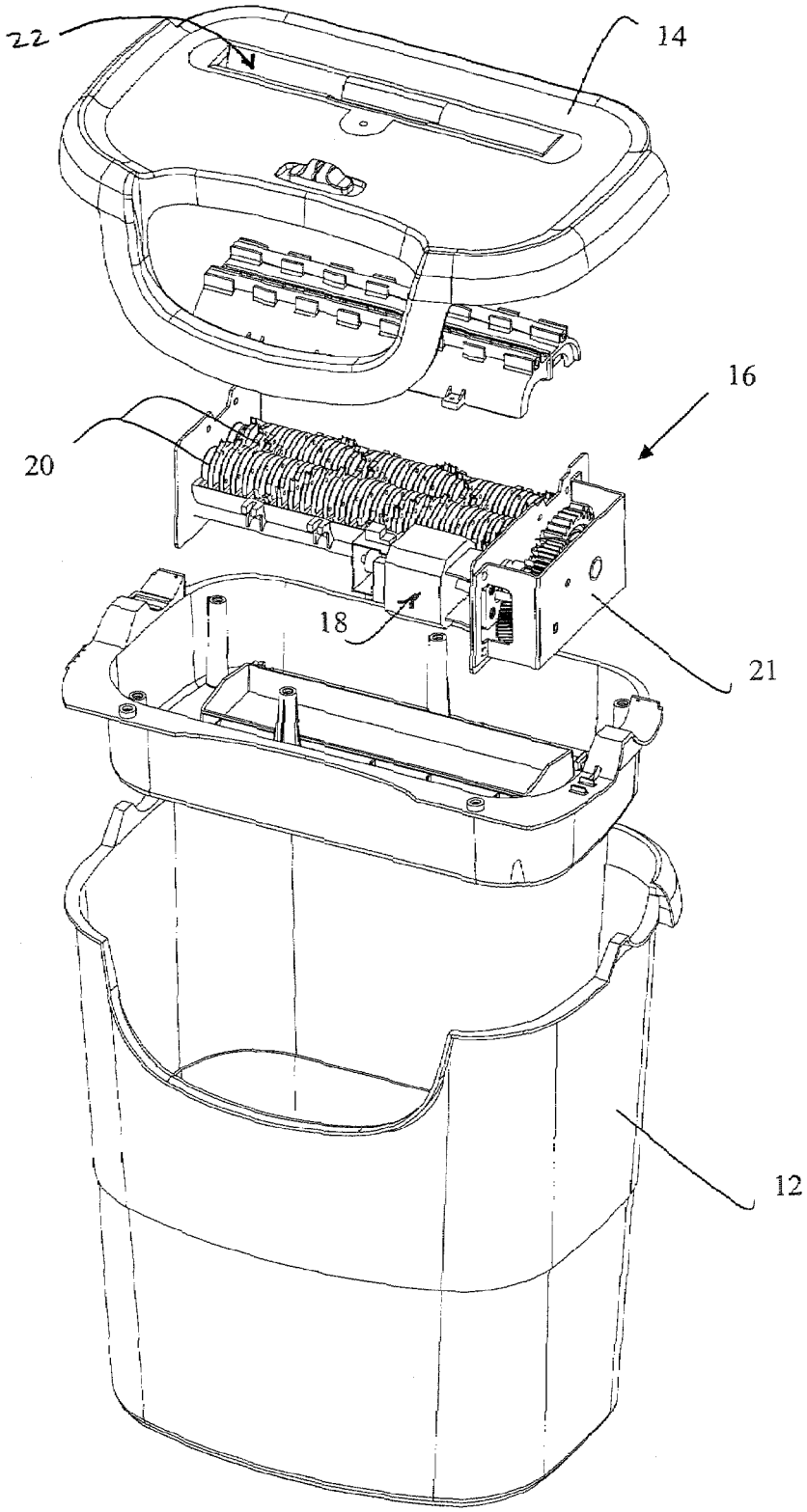
FIG. 2 is an exploded perspective view of the shredder of FIG. 1.
Figure 3:
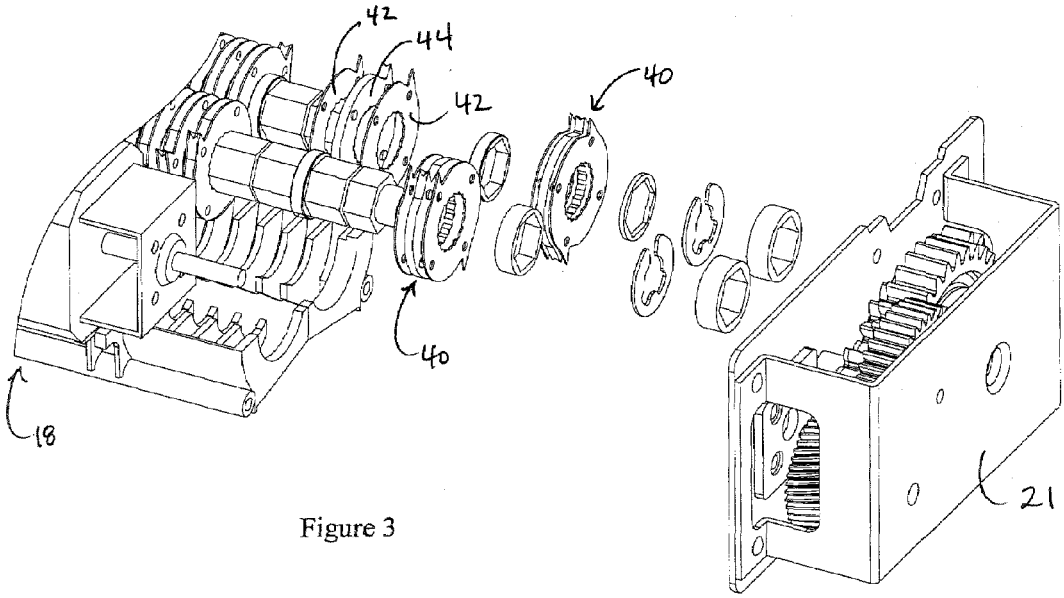
FIG. 3 is a detail view of the shafts and motor used in the shredder mechanism in accordance with the present invention.

FIGS. 1-3 illustrate a document shredder apparatus 10, commonly referred to as a shredder. Shredders are generally well-known in the art, and the following is a basic description of a shredder apparatus to be used with a preferred embodiment of the present invention. The shredder apparatus is generally indicated at 10 and is designed to destroy or shred data bearing substrates, such as paper, discs, and/or credit cards. Apparatus 10 sits on top of container 12, which is preferably a waste container. Preferably, apparatus 10 comprises housing 14 that sits on the upper periphery of container 12 in a nested relation. However, apparatus 10 may be of the type provided with an adaptable mount for attachment to a wide variety of containers. Housing 14 is designed to have opening 22 for receiving the data bearing substrates to be shredded. Generally speaking, apparatus 10 may have any suitable construction or configuration and the illustrated embodiment is not intended to be limiting in any way.

Apparatus 10 comprises shredder mechanism 16 which is received in housing 14, and includes a drive system 18 with at least one motor, such as an electrically powered motor, and a plurality of cutter elements 40 (further described with reference to FIGS. 4-8 below). The motor operates through a conventional transmission 21 using electrical power to rotatably drive a pair of rotatable first and second shafts 20 and their cutter elements 40 so that the cutter elements shred or destroy data bearing substrates fed through opening 22 and into the cutter elements 40 of shredder mechanism 16. First and second shafts 20 counter-rotate relative to each other. The drive system may have any number of motors, and may include one or more transmissions.

Figure 13:
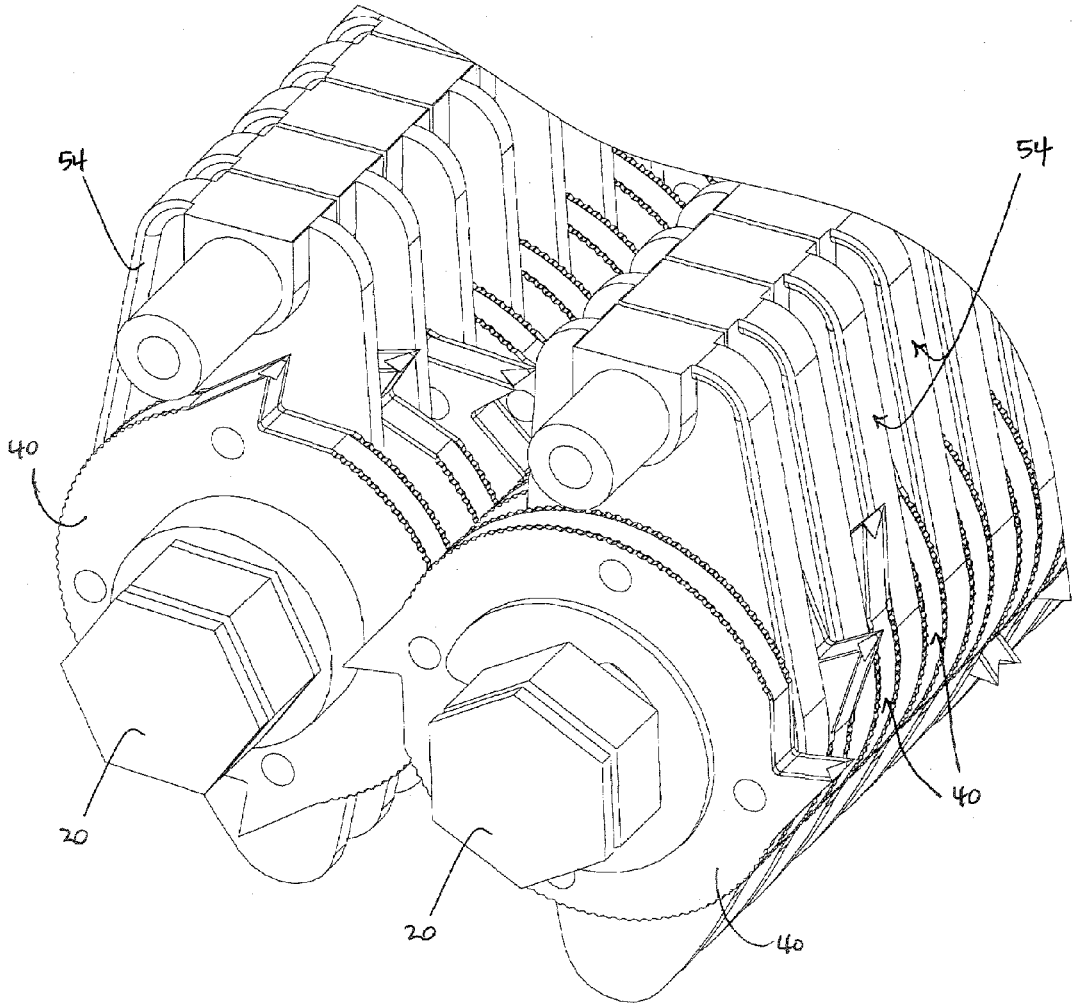
FIG. 13 is a perspective view of the cutter elements assembled on a first and second shaft in accordance with the present invention.
Figure 14:
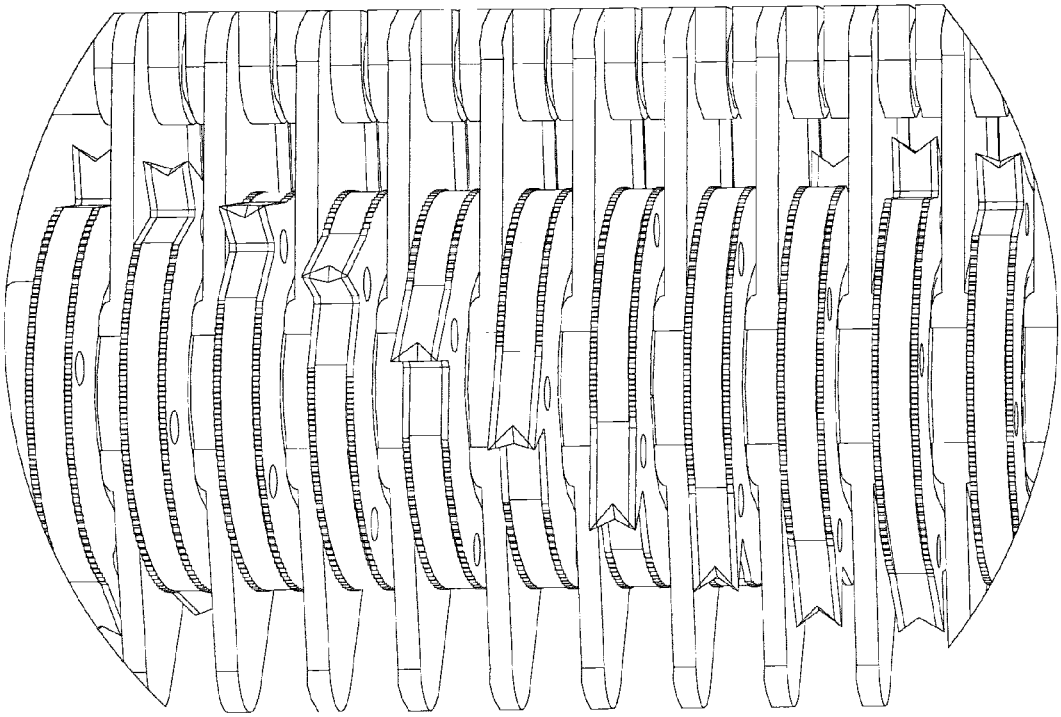
FIG. 14 and illustrate a detailed and side view of the cutter elements assembled on a shaft in accordance with the present invention.
Figure 15:
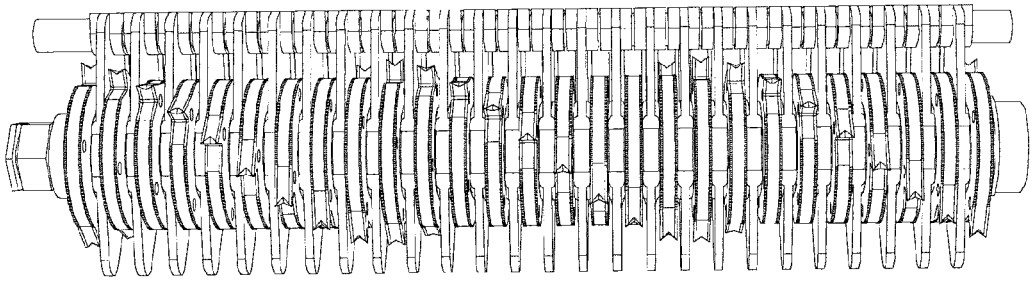
FIG. 15 is a side view of the cutter elements assembled on a first and second shaft in an interleaving relationship in accordance with the present invention.

The plurality of cutter elements 40 are mounted on pair of rotatable shafts 20 in any suitable manner. Preferably, the cutter elements are positioned along the first and second shafts 20 such that the cutter elements on each shaft are received in an interleaving relationship with the cutter element of the other shaft (see FIG. 13). This interleaving allows the overlapping portions of adjacent cutter elements to cut paper or other substrates in a scissors-like manner.

FIGS. 4-8 illustrate elements forming an individual cutter element 40 of the preferred embodiment of the present invention. Cutter element 40 comprises a pair of outer blades 42 and inner support 44 positioned between outer metal blades 42. Outer metal blades 42 and inner support 44 comprise central opening 45 for assembly onto shaft 20, further described below with reference to FIGS. 11 and 12.

Figure 4:
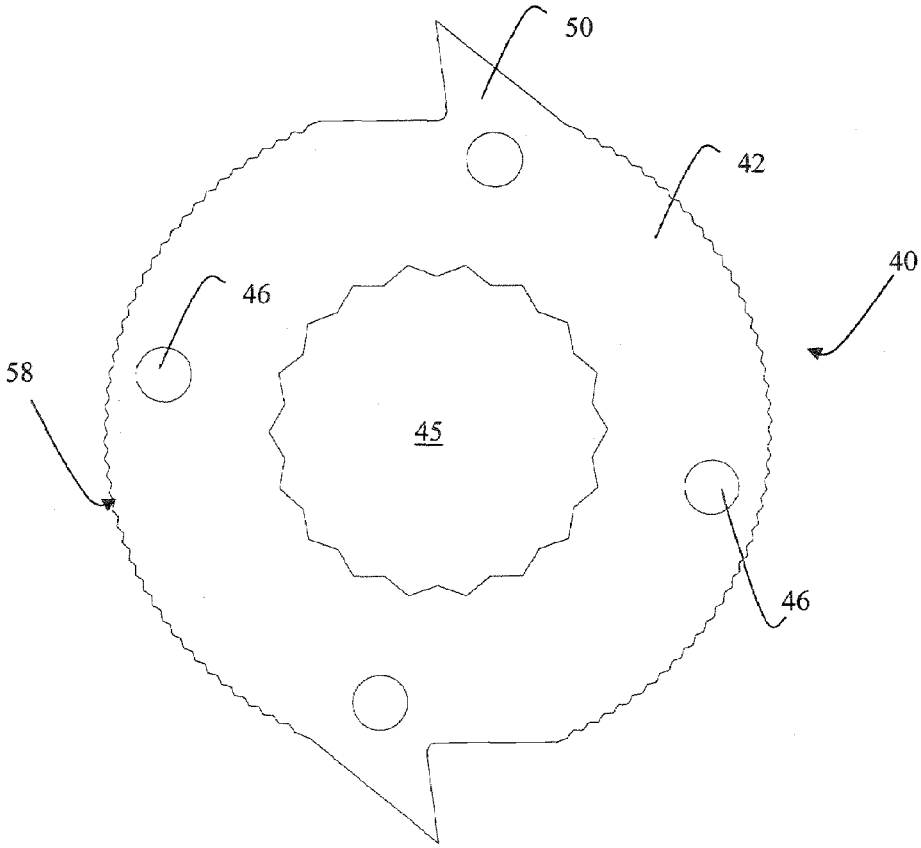
FIG. 4 is a side view of an outer blade that is used to form the cutter elements in accordance with the present invention.
Figure 5:
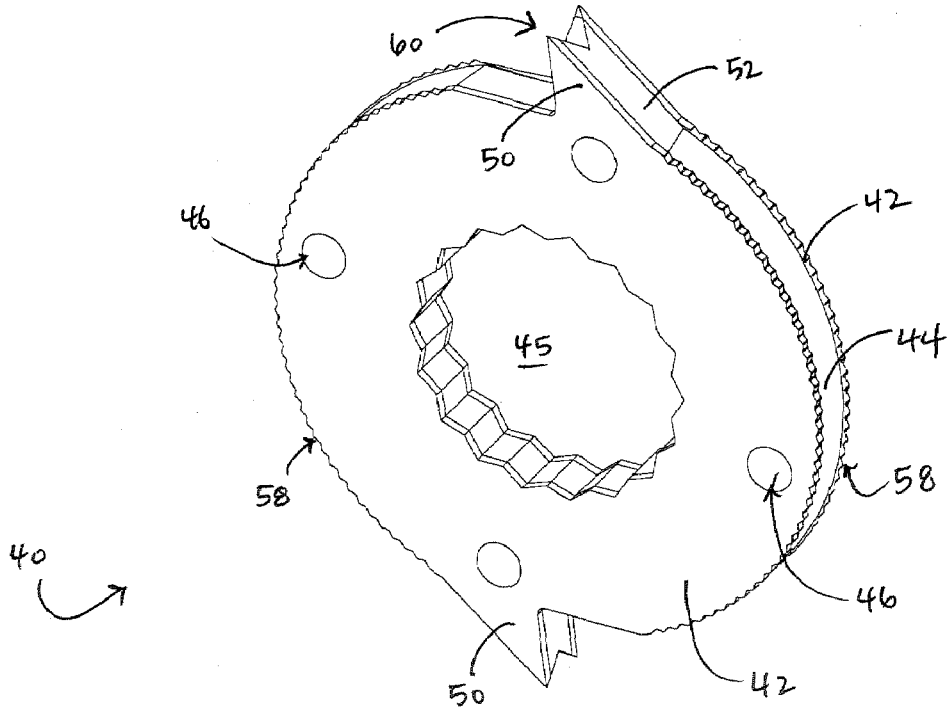
FIG. 5 is a perspective view of the inner support and outer blades used in an assembled cutter element in accordance with an embodiment.
Figure 6:
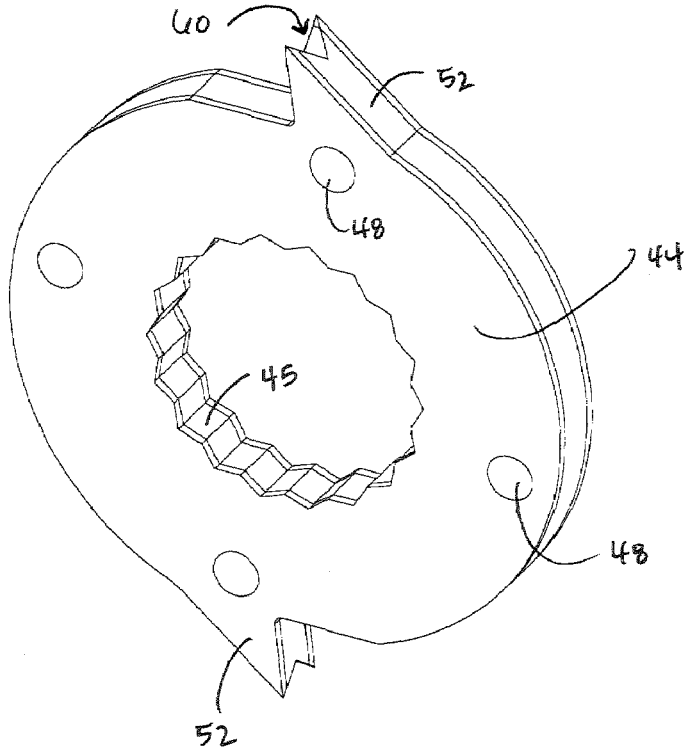
FIG. 6 is a detail view of the inner support and an integral cross-cut tooth in accordance with the present invention.

Outer metal blades 42 are preferably each shaped as one integral piece from metal, and each comprise at least one integral cross-cut tooth portion 50 (e.g., see FIG. 4). The cross cut tooth portion 50 of one blade 42 is designed to align circumferentially with cross cut tooth portion 50 of the other blade 42 to form the cutting tooth (e.g., see FIGS. 7 and 8). Inner support 44 comprises an integral tooth support portion 52 that is designed to align circumferentially with and positioned between each pair of cross cut tooth portions 50 of outer blades 42 when assembled. Inner support 44 has a main central body that is designed to support the main bodies of the outer blades 42. The tooth support 52 is preferably molded integrally as one piece with the main body on the periphery of inner support 44. Thus, inner support 44 and tooth support portion 52 support the outer blades 42 and the cross cut tooth portions 50. Particularly, tooth support portion 52 prevents cantilever-like deflection of tooth portions 50 on outer blades 42.

In addition, shown in the figures (e.g., FIGS. 5-8) is a groove shape 60 in the form of a "V" in tooth support portion 52 of the inner support 44. This V-shaped groove 60 is designed to aid in shredding substrates that are fed into the shredder and support the shredding process. The V-shaped groove 60 is designed to work in cooperation with the outer blades 42 by completing the shredding process until full separation of the substrate is achieved. More specifically, the groove prevents the cutter element from having a flat surface to which the cut substrate (e.g., paper) may cling, thus facilitating separation of the substrate from the cutter elements. However, the groove 60 is not a necessary part of the inner support 44. For example, the tooth support portion 52 of the inner support may have a tapered or angled design. Inner support 44 may also be of other shapes or configurations and should not be limiting.

Preferably, the pair of outer blades 42 are made of metal, such as steel or aluminum. Other materials for outer blades 42 that may also be used are ceramics, composite materials, or plastics, for example. The outer blades 42 are preferably but not necessarily of a significantly harder materials than the inner support 44.

Blades 42 may be formed by methods of stamping or punching or other machining processes known in the art. Other methods of forming the blades may include injection molding, casting, sintering, fine blanking, or others.

Figure 9:
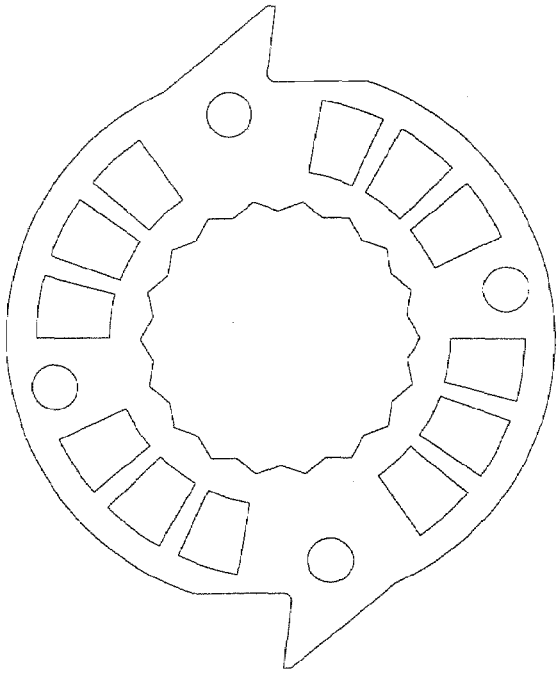
FIGS. 9 and 10 are a side and perspective views, respectively, of an embodiment of an inner support of a cutter element whose main body comprises a lattice-like structure.
Figure 10:
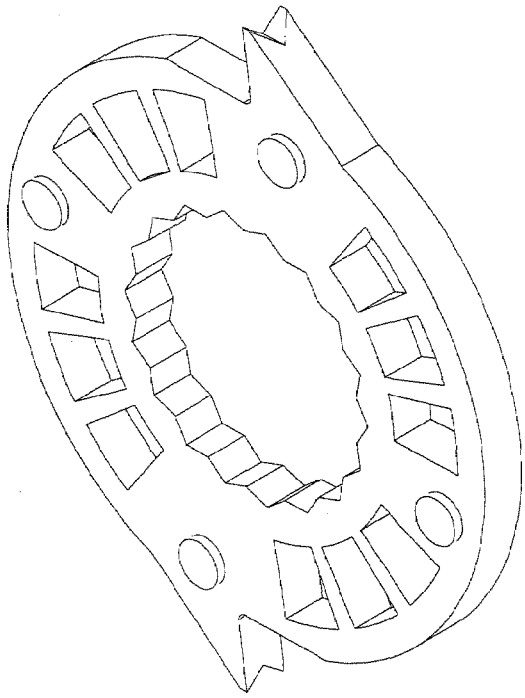

Inner support 44 is preferably made of molded plastic material. As shown in the figures, the main central body and tooth support portion(s) 52 of inner support 44 are molded of a solid piece of plastic. Alternatively, the main central body may have a lattice-like structure, as shown in FIGS. 9 and 10. This configuration saves material while still providing support to the outer blades 42 and tooth portions 50. In addition, inner support 44 may also be made of materials such as metals, ceramics, or composite materials, for example, and should not be limited to those mentioned.

Inner support 44 may be injection molded, as noted, or other formed from other methods such as stamping, casting, sintering, and fine blanking. Other constructions or configurations for inner support 44 are also possible and should not be limited to those mentioned above.

Preferably, the inner support 44 is made of less expensive material or by a less expensive process (e.g., molded plastic), thus providing for cost savings in the overall costs of the cutting elements. For example, the use of a molded plastic inner support 44 saves costs because it allows the blades 42 to be made from less expensive, thinner gauge materials with less cutting force, and the plastic is inexpensive and easy to mold.

Figure 7:
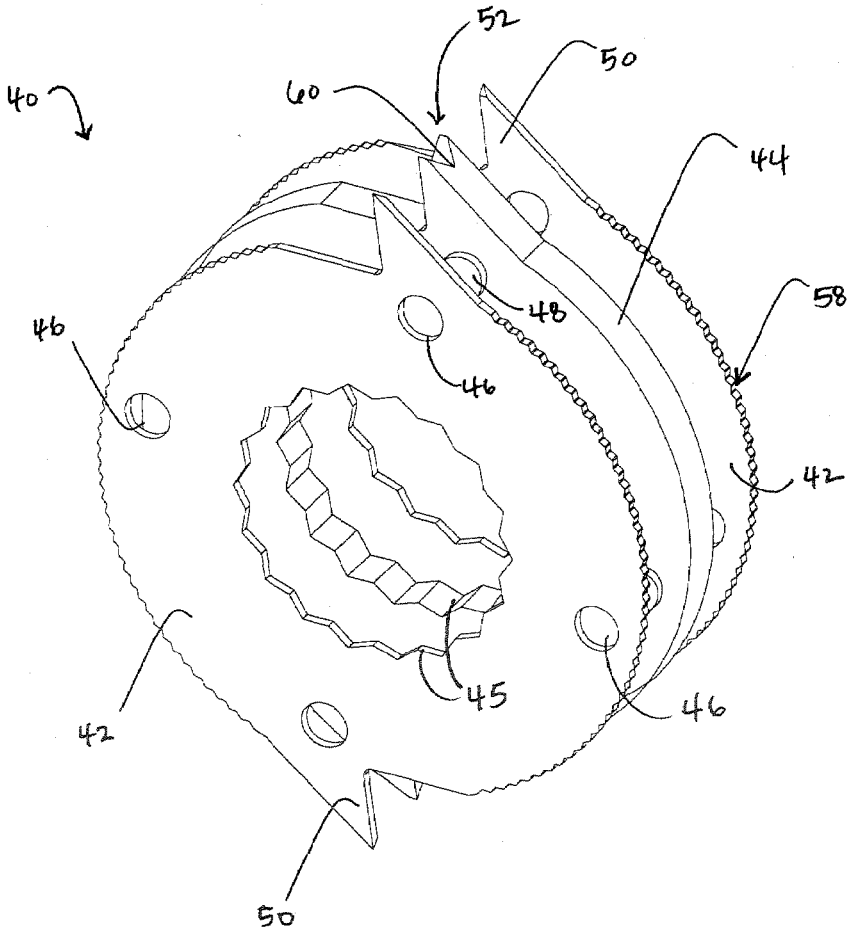
FIG. 7 is a detailed view of a snap-fit method of securing the outer blades and inner support together to form a cutter element in accordance with an embodiment of the present invention.
Figure 8:
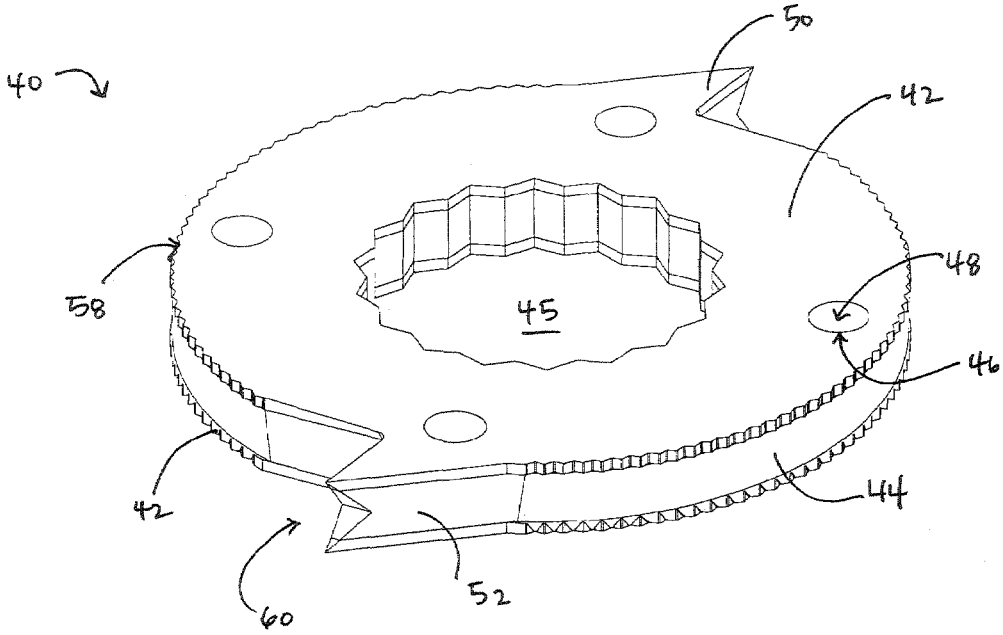
FIG. 8 is an alternate view of the assembled cutter element in accordance with the present invention.

In order to ease assembly of each cutting element 40, blades 42 and inner support 44 preferably comprise corresponding connectors to allow the pair of blades and inner support 44 to snap-fit together. Specifically, the pair of blades 42 has at least one hole or opening 46 on a side face of the blade (preferably through its entire thickness). Inner support 44 has a shaped projection 48 on each side of the support to fit tightly within opening 46 of each blade 42 on the sides (see FIG. 8). As shown in FIG. 7, to assemble and connect the blades 42 and inner support 44 to make the cutter element 40, opening 46 on one of the outer blades 42 is aligned with the shaped projection 48 on one side of inner support 44, and the opening 46 of the other outer blade 42 is aligned with the shaped projection 48 on the opposite side of the support 40. The blades 42 and support 44 may then be snapped together.

Although a plurality of corresponding connections are shown (i.e., openings 46 and projection 48), the number of connections for blades 42 and support 44 should not be limited. That is, one, two, three, or more openings and projections may be used to connect blades 42 and support 44.

However, the use of openings 46 and projections 48 to connect outer blades 42 and inner support 44 is not intended to be limiting. Additional methods may also be used to connect outer blades 42 and inner support 44. For example, instead of being snap-fit, the projections 48 and openings 46 may also be secured together by a friction or interference fit. Rivets may also be used to connect the blades and support by pushing the rivets through all three pieces. The inner support 44 may also be a molded insert; that is, the inner support 44 may be molded integrally with the two outer blades 42. Additionally, adhesives may be used alone or in cooperation with any of the above methods. Other known methods for a secure connection, such as ultrasonic welding, may also be used.

It is also possible to omit such features for securing the blades 42 and inner support 44 together; and the interface between their central openings 45 (discussed below) and the shaft 20 could be secured against relative rotation. For example, if the shaft has a faceted cross-section (e.g., a hexagon), the blades 42 and inner support 44 for a cutter element can be slid onto the shaft with their tooth support(s) aligned. Because their central openings 45 will likewise have a matching faceted configuration, rotation of the blades 42 and inner support 44 on the shaft 20 will be prevented. However, it is preferred to secure the blades 42 and inner support 44 together, as discussed above, prior to mounting on the shaft 20. This simplifies assembly, reduces the labor time associated with mounting the parts on the shaft 20, and ensures that no misalignment accidentally occurs between the blades 42 and inner support 44 of a cutter element. Also, securing those parts together minimizes the possibility of axial separation within a cutter element, which could capture paper, leading to clogging and poor performance.

Figure 11:
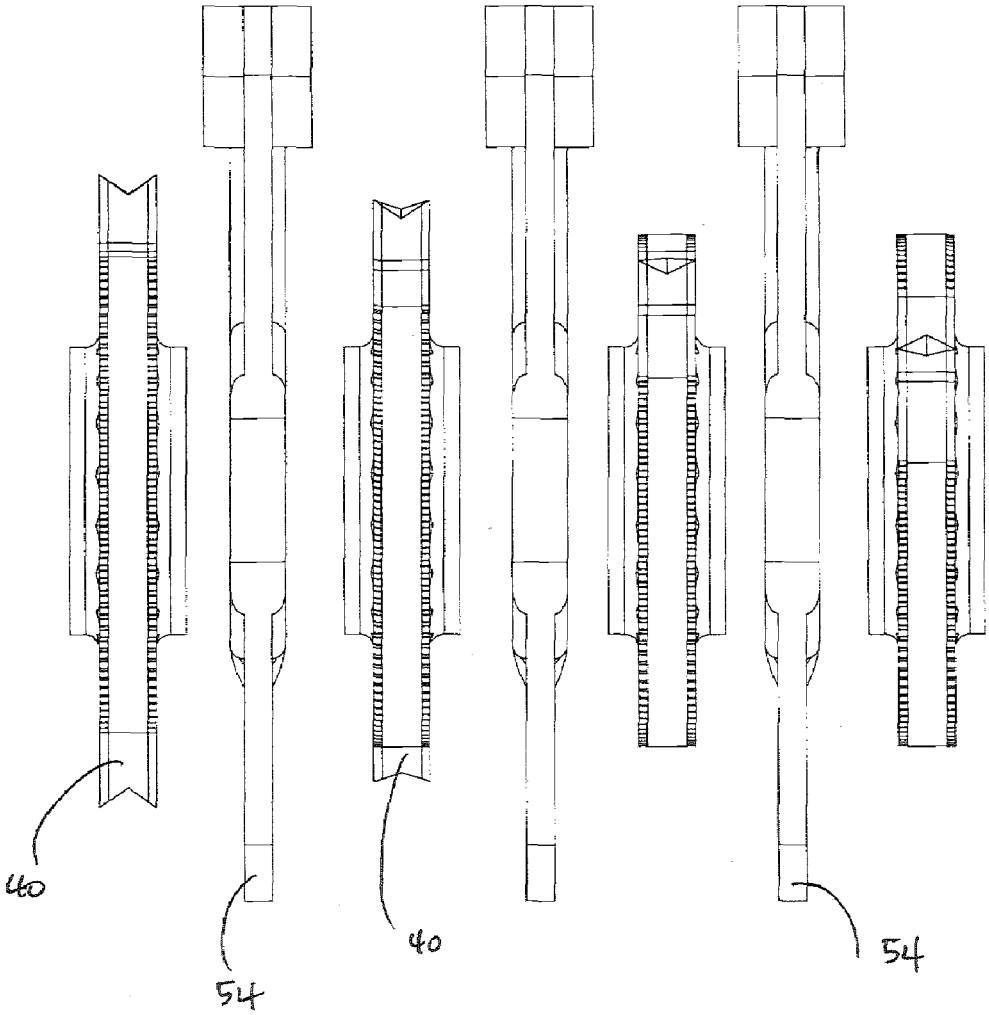
FIG. 11 is a side view of the assembly of the cutter elements with strippers and spacers in accordance with an embodiment of the present invention.
Figure 12:
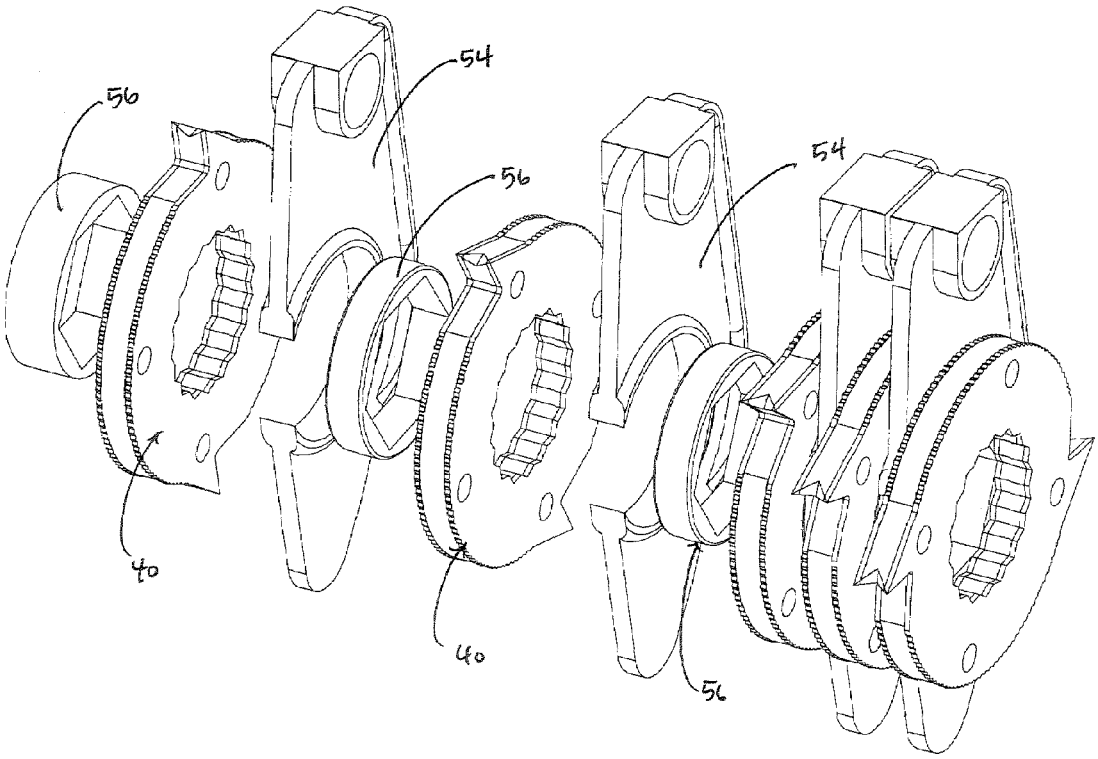
FIG. 12 is a perspective view of the cutter elements with strippers and spacers for assembling on a rotating shaft in accordance with the present invention.

Both outer blades 42 and inner support 44 each have a central opening 45. These openings 45 align when assembling the individual cutter elements 40. After each cutter element 40 is assembled and snap-fit together, a plurality of cutter elements are mounted or aligned on a rotatable shaft 20 using opening 45. FIGS. 11 and 12 show a plurality of cutter elements 40 aligned with stripper elements 54 and spacers 56 for assembly onto a rotating shaft in the shredder apparatus. The cutter elements 40 are arranged adjacent each other. Strippers 54 and spacers 56 are disposed between each of the cutter elements 40 positioned on or along the shafts. Since the cutter elements on a first shaft interleave with the cutter elements on a second shaft when paper or other substrate is being shredded, the strippers 54 are provided to strip away the shredded paper as it is fed through the cutter elements 40, thus preventing clogging of the cutting area and preventing the shredder mechanism 16 from jamming. Spacers 56 are provided to allow a space such that the cutter elements 40 on the first and second shafts 20 are capable of interleaving.

Figure 16:
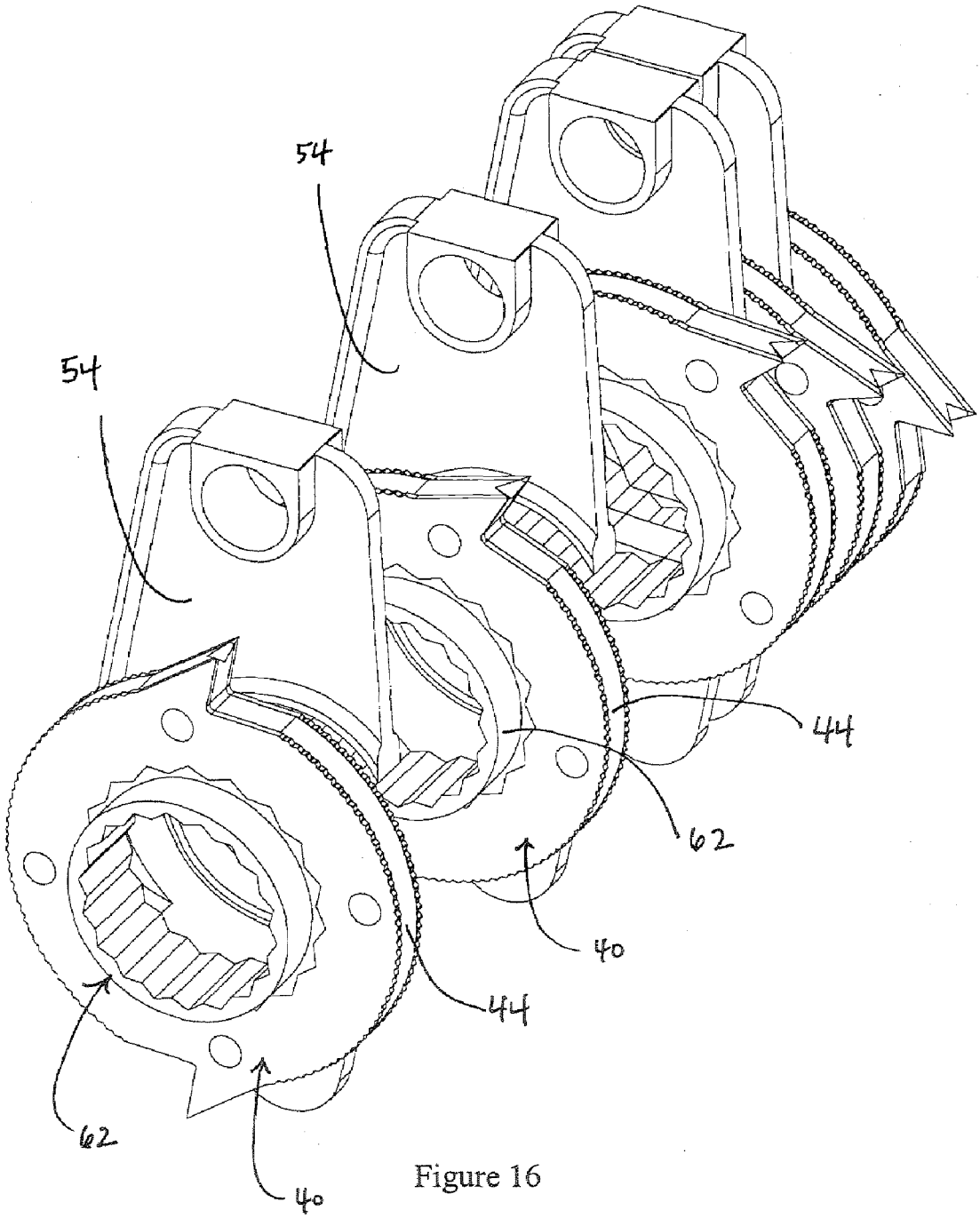
FIG. 16 illustrates a perspective view of an alternate embodiment showing the assembly of an inner support with integral, extended hub portions and outer blades forming a cutter element.

The presence of and the configuration of such strippers 54 and spacers 56 is not intended to be limiting. The separate spacers illustrated could be omitted and the spacers may be integral with at least one of the cutter elements 40. For example, protruding central hub portions could be formed on the blades 42 to provide the spacers. Or, the central openings 45 of the blades could be oversized, and integral central hub portions 62 of the inner support 44 could extend (or protrude) axially past the blades 42 through the central openings 45 to provide the spacers, as shown in FIG. 16. Thus, the spacers could have any construction or configuration. Likewise, the strippers could have any construction or configuration for mounting.

Also shown in the Figures on part of the outer blades 42 is a serrated edge 58. During operation, the serrated edges 58 are designed to support shredding of substrates (such as paper) by preventing the substrates from slipping while cutting.

The design of the outer blades 42 and inner support 44 provides superior long term use and characteristics. Particularly, the outer blades 42 are supported around the entire circumference, which prevents the blades 42 and tooth support portions 52 from deforming under loads that may be associated with long term use.

Preferably, but not necessarily, the outer blades 42 are parallel to one another, and have parallel outer and inner faces. This allows the cutting element to cut like a more traditional cutting element, with the benefit of the cost savings provided by using the inner support 44.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder for shredding data bearing substrates comprising:

a housing, a shredder mechanism received in the housing and including an electrically powered motor and a plurality of cutter elements, the shredder mechanism further comprising a first shaft and a second shaft that rotate relative to each other, and the cutter elements being positioned along the first and second shafts such that the cutter element on each shaft are received in an interleaving relationship with the cutter elements of the other shaft;

the shredder mechanism enabling one or more data bearing substrates to be fed into the cutter elements and the motor being operable to rotate the first and second shafts so that the cutter elements shred the one or more data bearing substrates;

the housing having an opening enabling the one or more data bearing substrates to be fed therethrough into the cutter elements of the shredder mechanism;

one or more of the cutter elements each comprising a pair of outer blades and an inner support positioned between the outer blades; wherein in each of the one or more cutting elements, the outer blades include at least a pair of integral cross-cut tooth portions aligned circumferentially with one another and the inner support includes an integral tooth support portion aligned circumferentially with and positioned between each pair of cross-cut tooth portions and to support the cross-cut tooth portions.

2. A shredder for shredding data bearing substrates according to claim 1, wherein the outer blades are formed from metal.

3. A shredder for shredding data bearing substrates according to claim 2, wherein the outer blades are formed from steel or aluminum.

4. A shredder for shredding data bearing substrates according to claim 3, wherein the inner support is formed from plastic.

5. A shredder for shredding data bearing substrates according to claim 4, wherein the inner support is molded plastic.

6. A shredder for shredding data bearing substrates according to claim 3, wherein the outer blades are stamped.

7. A shredder for shredding data bearing substrates according to claim 1, wherein the outer blades and inner support are snap-fit together.

8. A shredder for shredding data bearing substrates according to claim 1, wherein the cutter elements are arranged adjacent each other and further comprising a spacer disposed between the cutter elements.

9. A shredder for shredding data bearing substrates according to claim 8, wherein the spacer is integral with at least one of the outer blades of adjacent cutter elements.

10. A shredder for shredding data bearing substrates according to claim 8, wherein the spacer is integral with at least one of the inner supports of the adjacent cutter elements.

11. A shredder for shredding data bearing substrates according to claim 9, wherein the spacer is provided by a central hub portion formed on the inner support.

12. A shredder for shredding data bearing substrates according to claim 1, wherein the integral tooth support portion is designed with a shape to aid in shredding substrates.

* * * * *